US006879253B1

(12) United States Patent
Thuillard

(10) Patent No.: US 6,879,253 B1
(45) Date of Patent: Apr. 12, 2005

(54) METHOD FOR THE PROCESSING OF A SIGNAL FROM AN ALARM AND ALARMS WITH MEANS FOR CARRYING OUT SAID METHOD

(75) Inventor: Marc Pierre Thuillard, Uetikon am See (SE)

(73) Assignee: Siemens Building Technologies AG, Zurich (CH)

( * ) Notice: Subject to any disclaimer, the term of this patent is extended or adjusted under 35 U.S.C. 154(b) by 0 days.

(21) Appl. No.: 10/019,362

(22) PCT Filed: Mar. 6, 2000

(86) PCT No.: PCT/CH01/00136

§ 371 (c)(1),
(2), (4) Date: Mar. 6, 2003

(87) PCT Pub. No.: WO01/69566

PCT Pub. Date: Sep. 20, 2001

(30) Foreign Application Priority Data

Mar. 15, 2000 (EP) ..... 00105438

(51) Int. Cl.[7] ..... G08B 23/00

(52) U.S. Cl. ..... 340/526; 340/506; 706/8; 706/16

(58) Field of Search ..... 340/526, 506, 340/511, 577, 578, 657; 706/1, 3, 15, 16, 25

(56) References Cited

U.S. PATENT DOCUMENTS 6,011,464 A * 1/2000 Thuillard ..... 340/506

6,150,935 A * 11/2000 Anderson ..... 340/506

OTHER PUBLICATIONS

Jacob et al., "Empirical Validation of the Performance of a Class of Transient Detector", (1996), IEE XP–002144057.

Thuillard, "Fuzzy–wavelets: theory and applications", (1998), EUFIT' 98, XP 000934368.

Ma et al., "Wavelet Transform Based Sensor Validation", (1999), IEE XP 002144056.

* cited by examiner

*Primary Examiner*—Jeffery Hofsass
*Assistant Examiner*—Eric Blount
(74) *Attorney, Agent, or Firm*—Baker Botts LLP

(57) ABSTRACT

The signals of a danger detector that has at least one sensor (2, 3, 4) for monitoring danger parameters and an electronic evaluation system (1) assigned to the at least one sensor (2, 3, 4) are compared with specified parameters. In addition, the signals are analysed with regard to whether they occur increasingly frequently or regularly, and signals that occur increasingly frequently or regularly are classified as interference signals. The classification of signals as interference signals triggers an appropriate adjustment of the parameters. If interference signals occur, the validity of the result of the analysis of the signals of the at least one sensor (2, 3, 4) is checked prior to the adjustment of the parameters, and the parameters are adjusted as a function of the result of said validity test.

12 Claims, 3 Drawing Sheets

METHOD FOR THE PROCESSING OF A SIGNAL FROM AN ALARM AND ALARMS WITH MEANS FOR CARRYING OUT SAID METHOD

FIELD OF INVENTION

The present invention relates to a method for processing the signals of a danger detector that has at least one sensor for monitoring danger parameters and an electronic evaluation system that is assigned to the at least one sensor. The danger parameters are monitored by comparing the signals of the at least one sensor with specified parameters. The danger detector may be a smoke detector, a flame detector, a passive infrared detector, a microwave detector, a dual detector (passive infrared sensor+microwave sensor) or a noise detector.

BACKGROUND OF THE INVENTION

Modern danger detectors have achieved a sensitivity with regard to the detection of danger parameters that that the main problem is no longer the detection of a danger parameter as early as possible, but to distinguish reliably interference signals from true danger signals and thereby avoid false alarms. Danger signals and interference signals are distinguished substantially by using a plurality of different sensors and correlating their signals or by analyzing various features of the signals of a single sensor and/or by appropriate signal processing. A substantial improvement in interference immunity has already been achieved recently by using fuzzy logic.

Fuzzy logic is generally known. With regard to the evaluation of the signals of danger detectors, it is to be emphasized that signal values are allocated to fuzzy sets in accordance with a membership function. The value of the membership function, or the degree of membership of a fuzzy set, is between 0 and 1. It is important that the membership functions can be normalized, i.e. the sum of all the values of the membership function is equal to one, as a result of which the fuzzy logic evaluation permits an unambiguous interpretation of the signals.

SUMMARY OF THE PRESENT INVENTION

The object of the present invention is to provide a method for processing the signals of a danger detector that is further improved with regard to insensitivity to interference and interference immunity. The method according to the present invention is characterized in that the signals of the at least one sensor are analyzed on the basis of whether they occur increasingly frequently or regularly and in that signals occurring increasingly frequently or regularly are classified as interference signals. In a first preferred embodiment of the method according to the present invention the classification of signals as interference signals triggers an appropriate adjustment of the parameters.

The method according to the present invention is based on the novel insight that a fire detector, for example, rarely if ever "sees" more than a few real fires between two inspections or two power failures, and that signals occurring increasingly frequently or regularly indicate the presence of sources of interference. The interference signals due to the interference sources are recognized as such and the detector parameters are adjusted accordingly. In this way, the detectors operated by the method according to the invention are capable of learning and are better able to distinguish between true danger signals and interference signals.

Another preferred embodiment of the method according to the present invention where interference signals occur, is that the validity of the result of the analysis of the signals of the at least one sensor is checked prior to the adjustment of the parameters, and the parameters are adjusted as a function of the result of this validity test. It is further preferred if the validity is tested by methods based on multiple resolution.

Yet another preferred embodiment of the method according to the present invention comprises using wavelets, preferably "biorthogonal" or "second generation" wavelets or "lifting schemes" for the validity test. The wavelet transformation is a transformation or imaging of a signal of the time domain into the frequency domain (see, for example, "The Fast Wavelet-Transform" by Mac A. Cody in Dr. Dobb's Journal, April 1992) and is therefore basically similar to the Fourier transformation or fast Fourier transformation. However, it differs from the latter in the basic function of the transformation by which the signal is developed. In a Fourier transformation, a sine function and cosine function are used that are sharply localized in the frequency domain and indefinite in the time domain. In a wavelet transformation, a so-called wavelet or wave packet is used. Of the latter, there are various types, such as, for example, a Gauss, spline or hair wavelet that can each be displaced as desired in the time domain and expanded or compressed in the frequency domain by two parameters. Recently, novel wavelet methods have been disclosed that are often described as "second generation". Such wavelets are constructed using the so-called "lifting schemes" (Sweldens), which result in a series of approximations to the original signal, each of which has a coarser resolution than the preceding one. The number of operations necessary for the transformation is always proportional to the length of the original signal, whereas this number is disproportionate with respect to the signal length in the case of the Fourier transformation. The fast wavelet transformation can also be carried out inversely by restoring the original signal from the approximated values and coefficients for the reconstruction. The algorithm for resolving and reconstructing the signal and a table of resolving and reconstruction coefficients are given on the basis of an example for a spline wavelet in "An Introduction to Wavelets" by Charles K. Chui (Academic Press, San Diego, 1992); See also "A Wavelet Tour of Signal Processing" by S. Mallat (Academic Press, 1998).

In a further preferred embodiment of the method according to the present invention the expected values for the approximation coefficients, or the approximation coefficients and detailed coefficients of the wavelets, are determined and compared at different resolutions. Preferably, the coefficients are determined in an estimator or by means of a neuronal network.

The present invention further relates to a danger detector having means for carrying out the aforesaid method, having at least one sensor for a danger parameter and an electronic evaluation system, comprising a microprocessor, for evaluating and analyzing the signals of the at least one sensor. The microprocessor comprises a software program having a learning algorithm, based on multiple resolution, for analyzing the signals of the at least one sensor.

In a preferred embodiment of the novel danger detector the sensor signals are analyzed by the learning algorithm for their repeated or regular occurrence, and a validity test is carried out on the result. The learning algorithm for the validity test uses wavelets, preferably "biorthogonal" or "second generation" wavelets. It is also preferred if the learning algorithm uses neuro-fuzzy methods.

In another preferred embodiment of the danger detector the learning algorithm comprises the following two equations:

$f_m(x)=\Sigma\hat{c}_{m,n}\phi_{m,n}(x)$ ($\Sigma$ over all n's) and $\hat{c}_{m,n}(k)=\Sigma\phi_{m,n}(x_i)\cdot y_i/\Sigma\phi_{m,n}(x_i)$ ($\Sigma$ overall i's=1 to k), in which $\phi_{m,n}$ denotes wavelet scaling functions, $\hat{c}_{m,n}$ denotes approximation coefficients and $y_k$ denotes the $k^{th}$ input point of the neuronal network, and $\phi_{m,n}$ is the dual function of $\phi_{m,n}$ (for definition of dual function see S. Mallat).

BRIEF DESCRIPTION OF THE DRAWINGS

The present invention is explained in greater detail below with reference to exemplary embodiments and the drawings, in which.

DETAILED DESCRIPTION OF THE INVENTION

In accordance with the method of the present invention, the signals of a danger detector are processed in such a way that typical interference signals are detected and characterized. While fire detectors are predominantly mentioned in the present description, this in no way is intended to limit the scope of the invention and are but one of a number of detectors that have been chosen to exemplify the present invention. Hence method according to the present invention is not restricted to fire detectors, and to the contrary, the method is suitable for danger detectors of all kinds, including intruder detectors and movement detectors.

Interference signals are analyzed by a simple and reliable method. Importantly, the interference signals are not only detected and characterized, but also the result of the analysis is checked. Wavelet theory and multiple resolution analysis (multi-resolution analysis) are used. Depending on the result of the check, the detector parameters or the algorithms are adjusted. That means that the sensitivity is reduced or that certain automatic switchings between different sets of parameters are interlocked. By way of example, European Patent Application 99 122 975.8 describes a fire detector that has an optical sensor for scattered light, a temperature sensor and a fire gas sensor. The electronic evaluation system of the detector comprises a fuzzy controller in which the signals of the individual sensors are combined and the particular type of fire is diagnosed. A special application-specific algorithm is provided for each type of fire and can be selected on the basis of the diagnosis. In addition, the detector comprises various sets of parameters for personnel protection and property protection, between which on-line switching takes place under normal circumstances. If interference signals are diagnosed in the case of the temperature sensor and/or in the case of the fire gas sensor, the switching between these sets of parameters is interlocked.

If fuzzy logic is used, one of the problems to be solved is to translate the knowledge stored in a database into linguistically interpretable fuzzy rules. Neuro fuzzy methods developed for this purpose have not been convincing because they partly yield only fuzzy rules that are very difficult to interpret. On the other hand, so-called multiple resolution procedures offer a possibility of obtaining interpretable fuzzy rules. Their idea is to use a dictionary of membership functions that form a multiple resolution and to determine which are suitable membership functions for describing a control surface.

Figure 1:
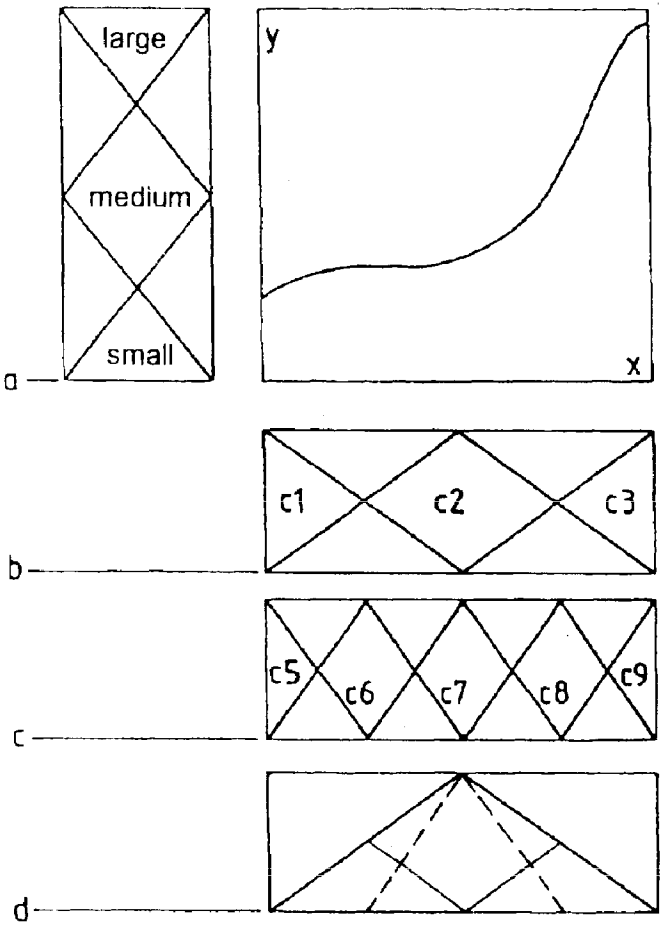
FIG. 1 shows a function explanation diagram.

FIG. 1 shows a diagram of such a multiple resolution. Row (a) shows the characteristic of a signal the amplitude of which varies in the ranges, small, medium and large. Correspondingly, row (b) shows the membership functions c1 "fairly small", c2 "medium" and c3 "rather large". These membership functions form a multiple resolution, which means that each membership function can be resolved into a sum of membership functions of a higher resolution level. This results in the membership functions c5 "very small", c6 "small to very small", c7 "very medium", c8 "large to very large" and c9 "very large" entered in row (c). In accordance with row (d), the triangular spline function c2 can therefore be converted into the sum of the translated triangle functions of the higher level of row (c).

In the Tagaki-Sugeno model, the fuzzy rules are expressed by the equation:

$$R_i\text{: if x is } A_i\text{, then } y_i=f_i(x_i), \tag{1}$$

wherein $A_i$'s are linguistic expressions, x is the linguistic input variable, and y is the output variable. The value of the linguistic input variables can be sharp or fuzzy. If, for example, $x_i$; is a linguistic variable for temperature, the value $\hat{x}$ may be a sharp number such as "30(° C.)", or a fizzy quantity such as "approximately 25(° C.)", "approximately 25" being itself a fuzzy set. For a sharp input value, the output value of the fuzzy system is given by the equation:

$$\hat{y}=\Sigma\beta_i f(\hat{x})/\Sigma\beta_i \tag{2}$$

where the degree of fulfillment $\beta_i$ is given by the expression $\beta_i=\mu_{A_i}(\hat{X})$ in which $\mu_{A_i}(\hat{X})$ denotes the membership function of the linguistic term $A_i$. In many applications, a linear function is taken: $f(\hat{x})=a^T i\cdot\hat{x}+b_i$. If a constant $b_i$ is taken to describe the sharp output value y, the system becomes:

$$R_i\text{: if x is } A_i \text{ then } y_i=b_i \tag{3}$$

If spline functions $N^k$ are taken, for example as membership function $\mu_{A_i}(\hat{x})=N^k[2^m(\hat{x}-n)]$, then the system of equation (3) is equivalent to $$y_i=\Sigma b_i N^k[2^m(\hat{x}-n)] \tag{4}$$

In this special case, the output y is a linear sum of translated and expanded spline functions. This means that, given equation (4), the Tagaki-Sugeno model is equivalent to a multiple resolution spline model. It follows from this that wavelet procedures can be applied.

Figure 2:
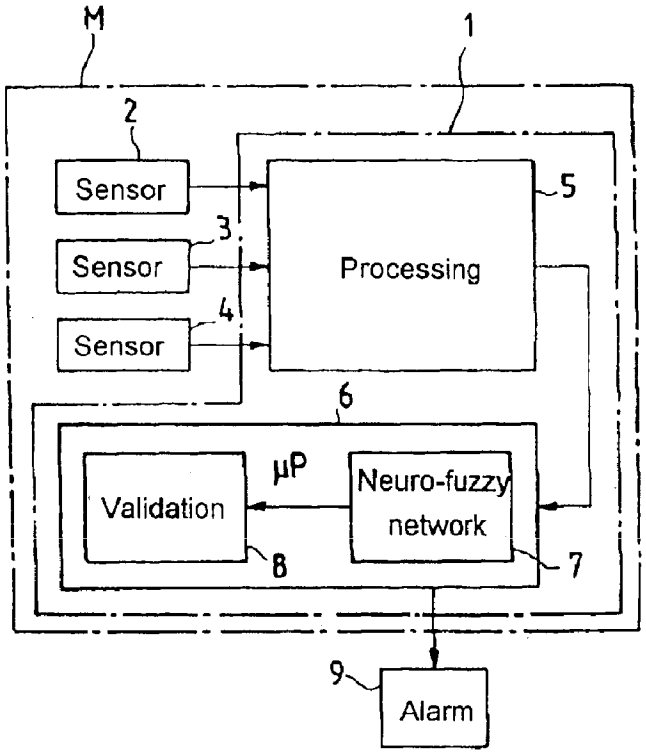
FIG. 2 shows a block diagram of a danger detector equipped with means for carrying out the method according to the invention.

FIG. 2 shows a block diagram of a danger detector equipped with a neuro-fuzzy learning algorithm. The detector denoted by the reference symbol M is, for example, a fire detector and has three sensors 2 to 4 for fire parameters. For example, an optical sensor 2 is provided for scattered light measurement or transmitted light measurement, a temperature sensor 3 and a fire gas sensor, for example a CO sensor, 4, are also provided. The output signals of the sensors 2 to 4 are fed to a processing stage 1 that has suitable means for processing the signals 5, such as, for example, amplifiers, and then are passed to a microprocessor or microcontroller denoted as $\mu$P 6.

In the $\mu$P 6, the sensor signals are compared both with one another and also individually with certain sets of parameters for the individual fire parameters. Of course, the number of sensors is not limited to three. Thus, only a single sensor may also be provided, and in this case, various characteristics, for example the signal gradient or the signal fluctuation, are extracted from the signal of the one sensor and investigated. Incorporated in the $\mu$P 6 are a neuro-fuzzy network 7 software and a validity test (validation) 8. If the signal resulting from the neuro-fuzzy network 7 is regarded as an alarm signal, an appropriate alarm signal is fed to an alarm-emitting device 9 or to an alarm centre. If the validation 8 reveals that interference signals occur repeatedly or regularly, the sets of parameters stored in the $\mu$P 6 are correspondingly corrected.

The neuro-fuzzy network 7 is a series of neuronal networks which use the symmetrical scaling functions $\phi_{m,n}(x)=\phi_{m,n}(x)=\phi[(x-n)\cdot 2^m]$ as an activation function. The scaling functions are such that $\{\phi_{m,n}(x)\}$ form a multiple resolution. Each neuronal network uses activation functions of a given resolution. The $m^{th}$ neuronal network optimizes the coefficients $\hat{c}_{m,n}$ with $f_m(x)$, the output of the $m^{th}$ neuronal network.

$$f_m(x)=\Sigma\hat{c}_{m,n}\cdot\phi_{m,n}(x)\ (\Sigma \text{ over all n's}) \tag{5}$$

The coefficients $\hat{c}_{m,n}$ are calculated using the following equations:

$$\hat{c}_{m,n}(k)=\Sigma\phi_{m,n}(x_i)\cdot y_i/\Sigma\phi_{m,n}(x_i)\ (\Sigma \text{ overall i's=1 to k}) \tag{6}$$

where $Y_k(x)$ is the $k^{th}$ input point and $\phi_{m,n}(x)$ is the dual function of $\phi_{m,n}(x)$. The two equations (5) and (6) form the main algorithm of the neuro-fuzzy network.

In each iteration step, the values of the various neuronal networks are checked crosswise (validated), using the wavelet resolution, namely the one that the approximation coefficient $\hat{c}_{m,n}$ of a level m can be obtained from the approximation coefficients and wavelet coefficients of the level m−1 using the reconstruction algorithm or resolving algorithm.

In a preferred version, $\phi_{m,n}(x)$ is a second-order spline function and $\phi_{m,n}(x)$ is an interpolation function. In a second version, $\phi_{m,n}(x)$ is a spline function and $\phi_{m,n}(x)$ is the dual function of $\phi_{m,n}(x)$. In a third version, $\phi_{m,n}(x)=\phi_{m,n}(x)$, where $\phi_{m,n}(x)$ is the hair function. In these cases, it is possible to implement the learning algorithm in a simple microprocessor.

Figure 3A:
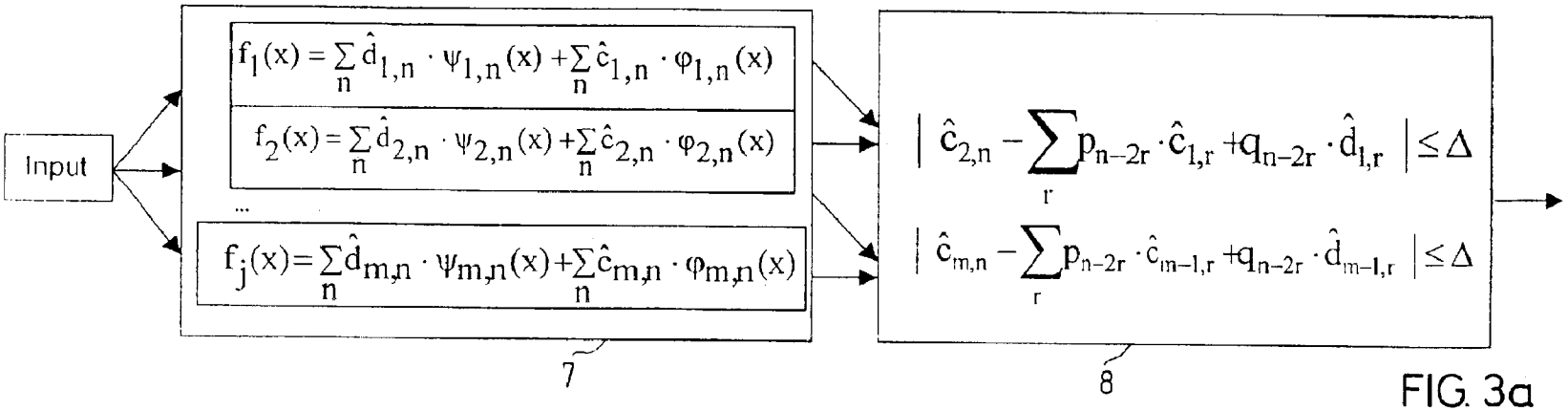
FIGS. 3*a*, 3*b* show two variants of a detail of the danger detector of FIG. 2.
Figure 3B:
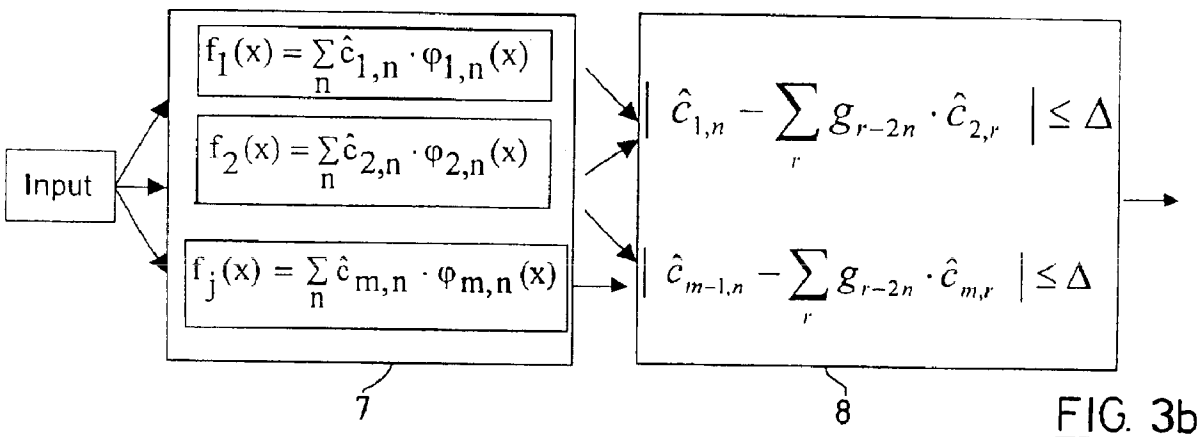

FIGS. 3*a* and 3*b* show two variants of a neuro-fuzzy network 7 and the associated validation stage 8. In FIG. 3*a*, the input signal is approximated in various resolution stages as the weighted sum of wavelets $\Psi_{m,n}$ and scaling functions $\phi_{m,n}$ having a given resolution. The validation stage 8 compares the approximation coefficients $\hat{c}_{m,n}$ with the approximation coefficients and detailed coefficients of the wavelets at the level of the next lower resolution stage. Wavelet reconstruction filter coefficients are denoted by p and q.

In the example of FIG. 3*b*, the input signal is approximated in various resolution stages as a weighted sum of scaling functions $\phi_{m,n}$ having a given resolution. The validation stage 8 compares the approximation coefficients $\hat{c}_{m,n}$ with the approximation coefficients at the next deeper resolution stage. Wavelet low-pass resolving coefficients are denoted by g.

Figure 4:
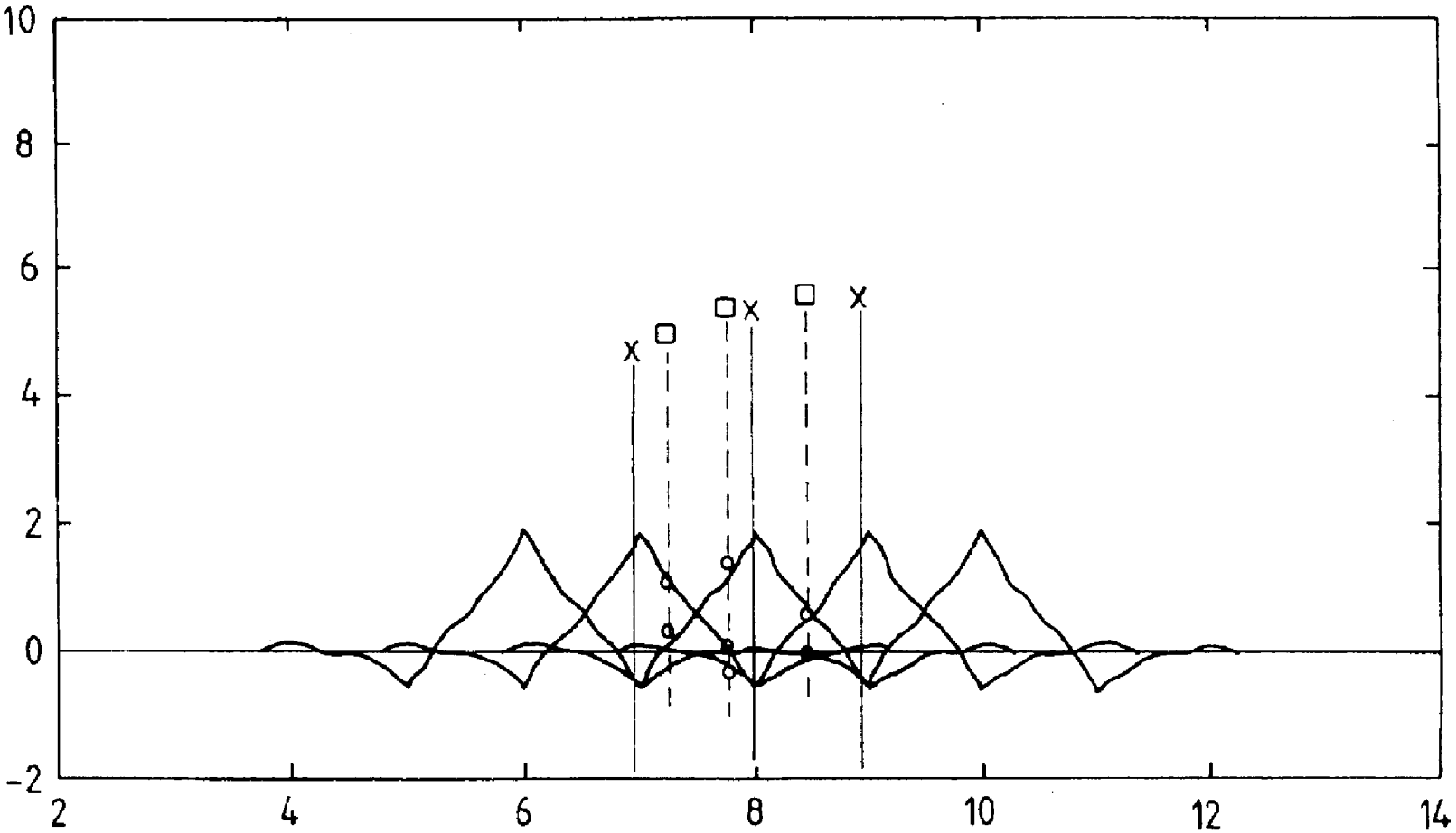
FIG. 4 shows a further variant of a detail of the danger detector of FIG. 3.

The said coefficients can be determined in an estimator of the type shown in FIG. 4 instead of in a neuro-fuzzy network 7. Said estimator is a so-called multiple resolution spline estimator that uses dual spline estimators based on the functions $\phi_{m,n}(x)$ to estimate the coefficients $\hat{c}_{m,n}$ in the equation the equation $f_m(x)=\hat{c}_{m,n}\cdot\phi_{m,n}(x)$. Wavelet spline estimators are used for adaptively determining the appropriate resolution for locally describing a basic hypersurface in an on-line learning process. A known estimator is the Nadaraya-Watson estimator with which the equation of the hypersurface f(x) is estimated using the following expression:

$$f(x)\sum_{k=1}^{k_{\max}} K((x-x_k)/\lambda)\cdot y_k \Big/ \sum_{k=1}^{k_{\max}} K((x-x_k)/\lambda). \tag{7}$$

Nadaraya-Watson estimators have two interesting characteristics they are estimators of the local mean quadratic deviation and it can be shown that they are so-called Bayes estimators of $x_k,y_k$ in the case of a random design, where $x_k,y_k$ are iid copies of a continuous random variable (X, Y).

The spline functions $\phi(x)$ and their dual function $\phi(x)$ can be used as estimators. We first use the function $\phi(x)$ to estimate f(x) using $\lambda=2^{-m}$ (m is an integer) from $x_n$, where $x_n\cdot 2^m\epsilon Z$:

Using the symmetry of $\phi(x)$, equation (6) for the dual spline function is equivalent to the use of an estimator centred at $x_n$:

$$\hat{f}(x_n)\sum_{k=1}^{k_{\max}} \tilde{\varphi}((x_k-x_n)\cdot 2^m)\cdot y_k \Big/ \sum_{k=1}^{k_{\max}} \tilde{\varphi}((x_k-x_n)\cdot 2^m). \tag{8}$$

The expected value of the numerator in equation (7) is proportional to the approximation coefficients $c_{m,n}$. Equation (6) yields an estimate of $\hat{c}_{m,n}$ in $f_m(x)=\Sigma\hat{c}_{m,n}\cdot\phi_{m,n}(x)$:

$$\hat{c}_{m,n}=\hat{f}(x_n). \tag{9}$$

In FIG. 4, the available data (values) are denoted by a small square, their projection on dual spline functions by a small circle and the estimate on a regular grid by a small cross.

To validate the coefficient $\hat{c}_n$, two conditions are necessary:

$$\left|\hat{c}_{m,n}-\sum_p g_{p-2n}\cdot\hat{c}_{m+1,p}\right|<\Delta \tag{10}$$

where the filter coefficients g correspond to the low-pass resolving coefficients for spline functions. In addition it is required that $$\left|\sum_{k=1}^{k_{\max}} \tilde{\varphi}((x_k-x_n)\cdot 2^m)\right|>T \tag{11}$$

so that divisions by very small values are prevented.

The strength of this method is that the calculation of a coefficient $\hat{c}_{m,n}$ requires the storage of only two values, the numerator and the denominator in equation (7). The method is therefore well suited for on-line learning using a simple microprocessor having low storage capacity.

The method can easily be adapted to density estimation by replacing equations (7) and (8) by the following equation:

$$\hat{c}_{m,n}=1/k_{\max}\cdot\sum_{k=1}^{k_{\max}} \tilde{\varphi}_{m,n}(x_k)\cdot y_k \tag{12}$$

What is claimed is:

1. A method for processing signals of a detector comprising at least one sensor for monitoring danger parameters and an electronic evaluation system assigned to the at least one sensor wherein signals from the at least one sensor are compared with specified parameters, and the signals are analyzed on the basis of an occurrence of the signals and depending on a pattern of the occurrence are classified as interference signals.

2. A method according to claim 1, wherein the classification of signals as interference signals triggers an appropriate adjustment of the specified parameters.

3. A method according to claim 2, wherein the analysis of the signals is tested for validity prior to the adjustment of the parameters and the parameters are adjusted as a function of the validity test.

4. A method according to claim 3, wherein the validity is tested by methods based on multiple resolution.

5. Method according to claim 4, wherein wavelets, selected from the group consisting of biorthogonal and second generation wavelets and lifting schemes are used for the validity test.

6. A method according to claim 5, wherein coefficients of the wavelets selected from the group consisting of approximation coefficients, and detailed coefficients have expected values which are determined and compared at different resolutions.

7. A method according to claim 6, wherein the coefficients are determined in an estimator.

8. A method according to claim 6, wherein the coefficients are determined by means of a neuronal network.

9. A detector for carrying out the method according to claim 1, comprising at least one sensor for sensing a danger parameter and an electronic evaluation system comprising a microprocessor for evaluating and analyzing signals emitted from at least one sensor wherein the microprocessor comprises a software program having a learning algorithm, based on multiple resolution, for analyzing the signals of the at least one sensor.

10. A detector according to claim 9, wherein the sensor signals are analyzed by the learning algorithm for their occurrence and a validity test is carried out on the analysis by a learning algorithm which uses wavelets selected from the group consisting of biorthogonal wavelets, second generation wavelets and lifting schemes.

11. A detector according to claim 9, wherein in that the learning algorithm uses neuro-fuzzy methods.

12. A detector according to claim 11, wherein the learning algorithm comprises two equations $$f_m(x)=\Sigma\hat{c}_{m,n}\cdot\phi_{m,n}(x) \text{ (}\Sigma\text{ over all n's) and}$$

$$\hat{c}_{m,n}(k)=\Sigma\phi_{m,n}(x_i)\cdot y_i/\Sigma\phi_{m,n}(x_i) \text{ (}\Sigma\text{ over all i's=1 to k),}$$

in which $\phi_{m,n}$ denotes scaling functions, $\hat{c}_{m,n}$ denotes approximation coefficients and $y_k$ denotes the $k^{th}$ input point of the neuronal network and $\phi_{m,n}$ is the dual function of $\phi_{m,n}$.

* * * * *